US006398598B2

(12) United States Patent
Masumoto

(10) Patent No.: US 6,398,598 B2
(45) Date of Patent: Jun. 4, 2002

(54) ELECTRICAL CONNECTOR

(75) Inventor: Toshio Masumoto, Musashimurayama (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/925,986

(22) Filed: Aug. 9, 2001

(30) Foreign Application Priority Data

Aug. 10, 2000 (JP) ..... 2000-242189

(51) Int. Cl.[7] ..... H01R 4/48
(52) U.S. Cl. ..... 439/862
(58) Field of Search ..... 439/862, 630, 439/66, 733.1

(56) References Cited

U.S. PATENT DOCUMENTS 5,975,959 A * 11/1999 Joly ..... 439/630

FOREIGN PATENT DOCUMENTS

JP 11-102758 4/1999

* cited by examiner

*Primary Examiner*—Brian Sircus
*Assistant Examiner*—Javaid Nasri
(74) *Attorney, Agent, or Firm*—Michael Best & Friedrich LLC; Laff, Whitesel & Saret, Ltd.; J. Warren Whitesel

(57) ABSTRACT

In an electrical connector having at least one contact (2) held in at least one contact accommodating groove (3*a*) formed in an insulator (3), the contact (2) comprises a base portion (21) press-fitted in the contact accommodating groove (3*a*), a contact portion (22) projecting (2*a*) from the contact accommodating groove (3*a*) upward, and a U-shape spring portion (2*b*) connecting the base portion (21) and the contact portion (22). The contact accommodating groove (3*a*) comprises a relatively large width section (3*a*-1) adjacent to the end wall (3*e*) and a relatively small width section (3*a*-2) adjacent to the open end. Opposite side walls at the relatively small width section (3*a*-2) are formed with press-fit grooves (3*d*) adjacent to the bottom wall (3*c*). The base portion (21) of the contact (2) is formed with lateral projections (2*c*) laterally projecting from the opposite sides of the base portion (21), and the lateral projections (2*c*) are press-fit in the press-fit grooves (3*d*) respectively. The base portion (21) of the contact (2) has a slender part which extends between the U-shape spring portion (2*b*) and the lateral projections (2*c*) and which is smaller in width than the width of the relatively small width section (3*a*-2) of the contact accommodating groove (3*a*).

17 Claims, 7 Drawing Sheets

ELECTRICAL CONNECTOR

BACKGROUND OF THE INVENTION

This invention relates to an electrical connector which connects a printed circuit board to another printed circuit board, a flexible printed circuit, a liquid crystal display, etc.

A conventional electrical connector will be described referring to FIGS. 1, 2, and 3. The conventional electrical connector is described in Japanese Unexamined Patent Publication (JP-A) No. 102758 of 1999.

A main body 31 of the connector is a generally rectangular parallelepiped-shaped insulator which is molded of resin. The main body 31 has a plurality of grooves 33 formed therein parallel to one another. Thus, each of the grooves is defined by a bottom wall 32, an upper wall 35 confronting the bottom wall 32, and opposite side walls. The upper wall 35 is provided with a plurality of openings 34. The bottom wall 32 is provided with an accommodating space 36 connecting with the groove 33. The side walls are provided with press-fit grooves 37 along the both sides of the groove 33, respectively.

Each of a plurality of contacts 41 are inserted into each of the grooves 33, respectively. Each of the contacts 41 is made of elastic copper alloy to a long plate-shape. Each contact 41 has a base portion 42 and a contact portion 43 narrower than the base portion 42, both of which are connected to each other through a U-shape bent portion 41*a*. The contact portion 43 can elastically displaced around the bent portion 41*a*. The contact portion 43 is provided with a projecting portion 43*a* which is formed by bending the contact portion 43 in the vicinity of a free end of the contact portion 43 into an inverted V-shape. The base portion 42 has a rectangular accommodating hole 42*a* under the contact portion 43. When the contact portion 43 is downward displaced about the bent portion 41*a*, it passes through the accommodating hole 42*a* and is received in the accommodating space 36. Two triangular press-fit projections 42*b* are formed at both sides of the crosswise direction of the base portion 42, respectively, and are fitted into the press-fit grooves 37, respectively. The base portion 42 is provided with a terminal portion 44 at an end opposite to the bent portion 41*a*.

FIG. 1 shows the state that the connector is mounted on the surface of a first printed circuit board 51. The main body 31 is supported on the first printed circuit board 51 and the terminal potion of each of the contacts 41 is connected and fixed to a circuit pattern (not shown) on the first printed circuit board 51. The projecting portion 43*a* of the contact 41 protrudes by the height h from the upper surface of the confronting wall 35 of the main body 31.

Now, a second printed circuit board 52 to be connected to the first printed circuit board 51 through the connector is disposed at the distance d away from the surface of the first printed circuit board 51, and is in contact with the projecting portion 43*a* of the contact 41. Then, the second printed circuit board 52 is pushed down to the first printed circuit board 51, the contact portion 43 of the contact 41 deforms elastically from the position shown by the solid line to the position shown by the two dots-chain line in FIG. 1. The second printed circuit board 52 stops at the position when the lower surface thereof has run against the upper surface of the upper wall 35. At this time, a circuit pattern (not shown) of the second printed circuit board 52 connects with the circuit pattern (not shown) of the first printed circuit board 51 by way of a route from the projecting portion 43*a* of the contact 41, through the contact portion 43, the base portion 42, and the terminal portion 44.

In the conventional connector, a stroke of the projection portion 43 moved by the second printed circuit board 52 pushed down is sufficiently large because of the provision of the accommodating hole 42*a* and accommodating space 36. At that time, the contact portion 43 is lowered through the accommodating hole 42*a* below the base portion 42 as shown by the imaginary line and a curvature of the bent portion 41 is therefore increased so that the bent portion 41*a* may unfortunately be plastically deformed. In order to avoid the undesired plastic deformation of the bent portion 41*a*, it is desired to increase the width of the bent portion 41*a*. However, the width of the bent portion 41*a* is limited as described below. In assembling the conventional electrical connector, the press-fit projections 42*b* are formed so as to guide the contact 41 press-fitted into the main body 31 of the connector, in cooperation with the press-fit grooves 37 formed in the main body 31. Therefore, the width of the bent portion 41*a* of the contact 41 cannot be formed with a size greater than an interval between the opposite side walls of the grooves 33 where the press-fit grooves 37 are formed.

Further, since the base portion 42 is provided with the accommodating hole 42*a* through which the contact portion 43 passes, widths of the base portion 42 and the groove 33 cannot be made so small so that the connector is impossible to be made with a small size as desired.

SUMMARY OF THE INVENTION

It is therefore an object of this invention to provide an electrical connector having a plurality of contacts with a compact size wherein the contacts are stably held, and have excellent elasticity with a desired stroke of contact region of the contact portion.

This invention is applicable to an electrical connector having at least one contact held in at least one contact accommodating groove formed in an insulator, the contact accommodating groove defined by a bottom wall, opposite sidewalls, and an end wall and being open upward and at the opposite end, the contact comprising a base portion press-fitted in the contact accommodating groove, a contact portion projecting from the contact accommodating groove upward, and a U-shape spring portion connecting the base portion and the contact portion.

In the electrical connector according to this invention:

- the contact accommodating groove comprises a relatively large width section adjacent to the end wall and a relatively small width section adjacent to the open end;
- the opposite side walls at the relatively small width section being formed with press-fit grooves adjacent to the bottom wall;
- the base portion of the contact being formed with lateral projections laterally projecting from the opposite sides of the base portion, the lateral projections being press-fit in the press-fit grooves respectively; and
- the base portion of the contact has a slender part which extends between the U-shape spring portion and the lateral projections and which is smaller in width than the width of the relatively small width section of the contact accommodating groove.

The U-shape spring portion of the contact preferably has a width less than but approximately equal to the width of the relatively large width section of the contact accommodating groove.

The contact portion of the contact preferably has a width smaller than the U-shape spring portion, and the contact portion is slantingly and upward bent at a bent portion apart from the U-shape spring portion and is folded to form a U-shaped folded portion projecting slantingly and upward.

According to another embodiment, the electrical connector has a plurality of the contacts which are accommodated in a plurality of contact accommodating grooves, respectively.

In an embodiment, the plurality of contact accommodating grooves are arranged at both sides of a central partitioning wall and in parallel with each other in each of the sides.

The end wall of each of the plurality of contact accommodating grooves is preferably defined by the partitioning wall.

The partitioning wall preferably has a top end with small flange portions oppositely therefrom to the contact accommodating grooves at both sides of the partitioning wall, the top end and the flange portion forming a flat upper surface.

DESCRIPTION OF THE PREFERRED EMBODIMENT

Figure 1:
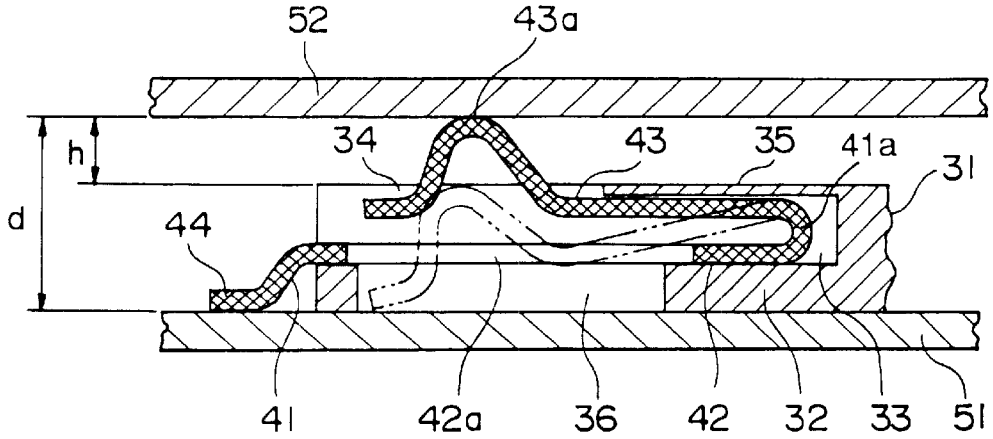
FIG. 1 PRIOR ART
FIG. 1 is a sectional view of a conventional electrical connector.
Figure 2:
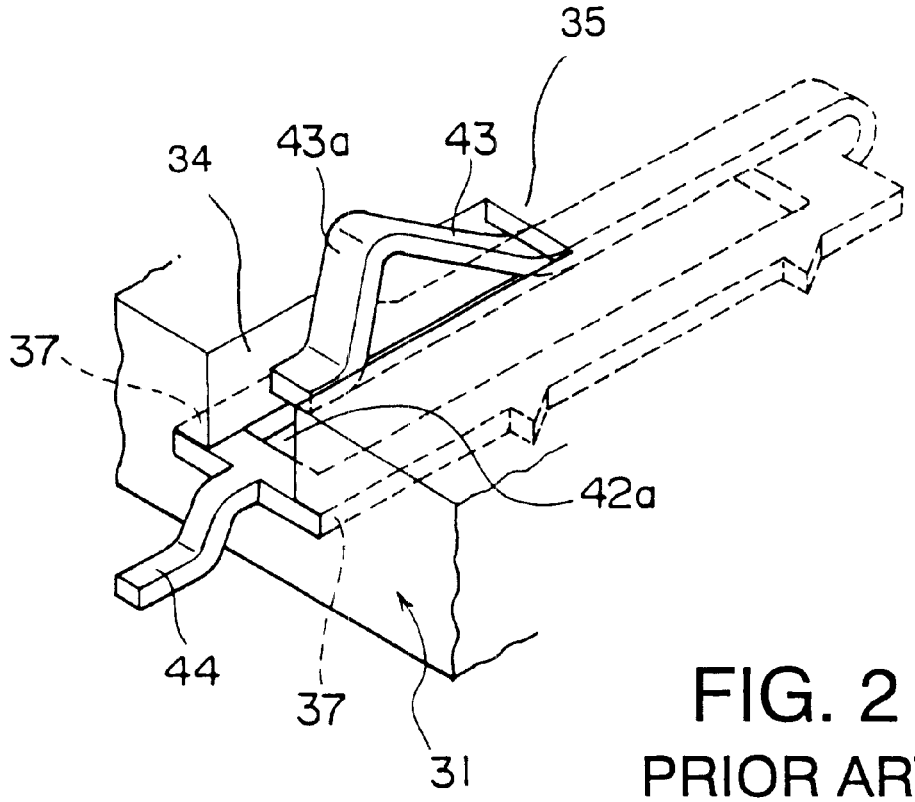
FIG. 2 PRIOR ART
FIG. 2 is a perspective view of the conventional electrical connector.
Figure 3:
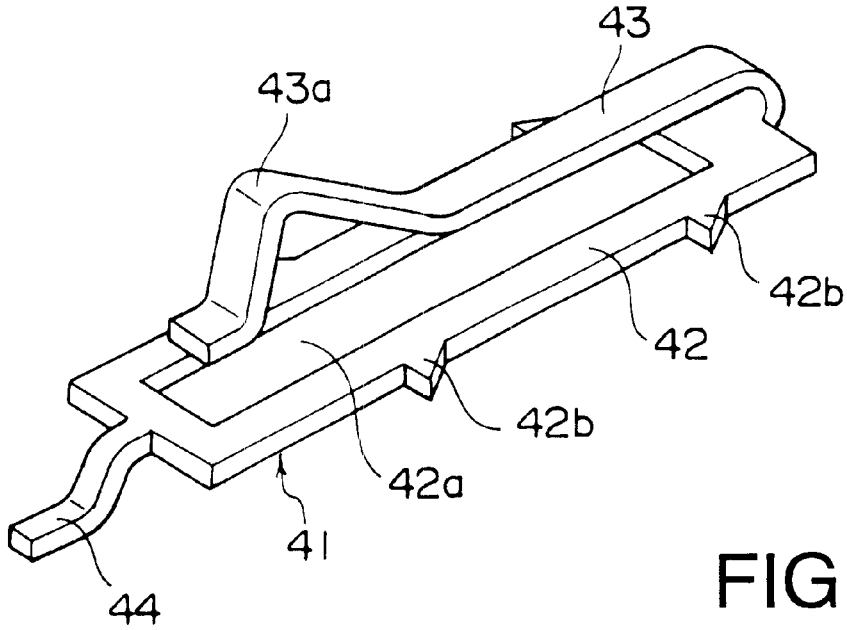
FIG. 3 PRIOR ART
FIG. 3 is a perspective view of a contact of the conventional electrical connector.
Figure 4A:
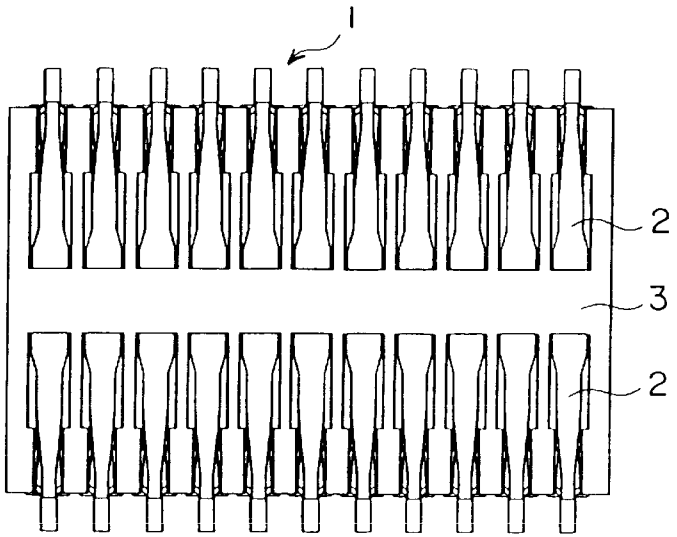
FIG. 4A is a plan view of an electrical connector according to an embodiment of this invention.
Figure 4B:
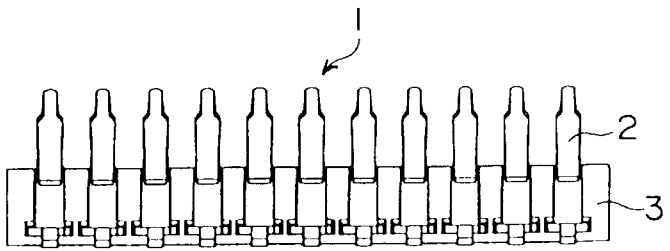
FIG. 4B is a front view of the electrical connector according to the embodiment of this invention.
Figure 4C:
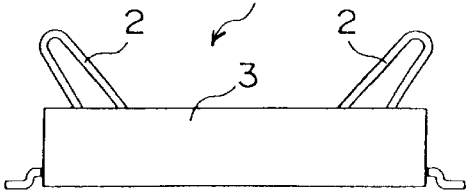
FIG. 4C is a side view of the electrical connector according to the embodiment of this invention.
Figure 4D:
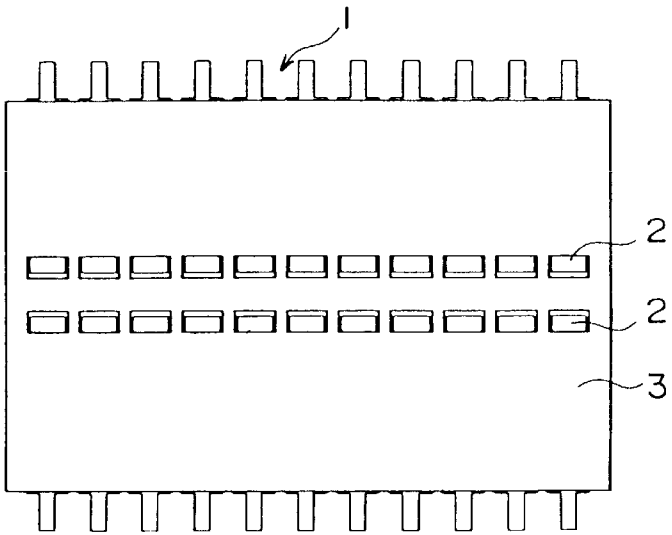
FIG. 4D is a bottom view of the electrical connector according to the embodiment of this invention.
Figure 5:
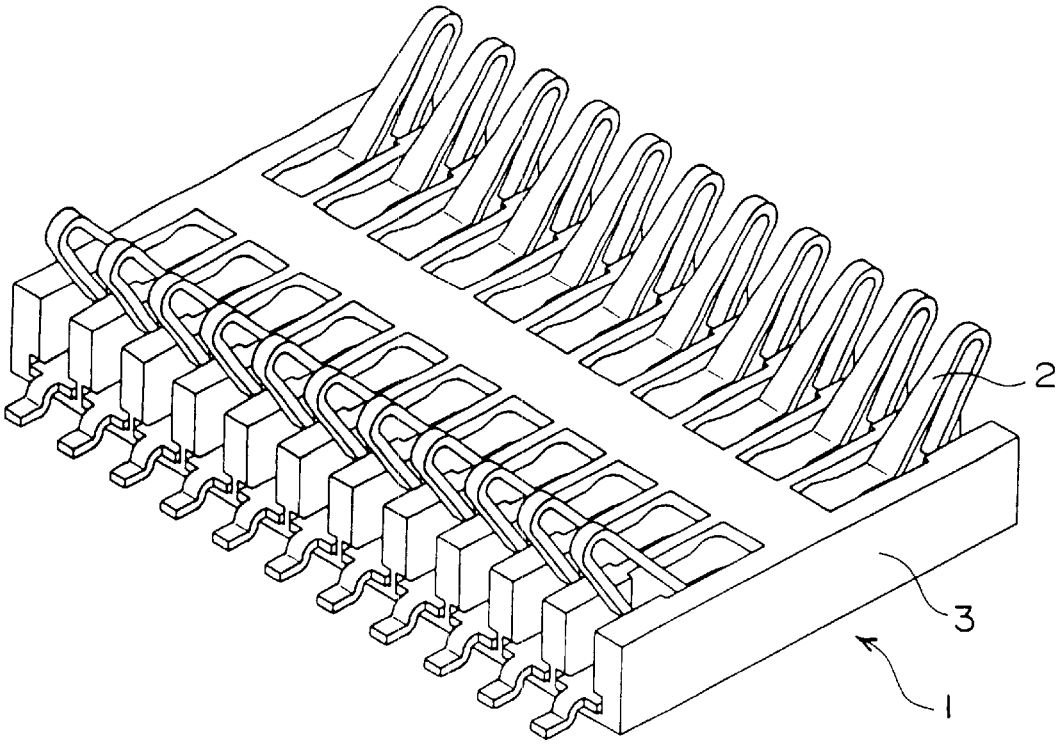
FIG. 5 is a perspective view of the electrical connector according to the embodiment of this invention.

Referring now to FIGS. 4A to 8A, the description will proceed to an electrical connector according to a preferred embodiment of this invention. As shown in FIGS. 4A to 5, a connector 1 comprises a plurality of contacts 2 disposed oppositely in two rows and an insulator 3 holding the contacts 2.

Figure 6:
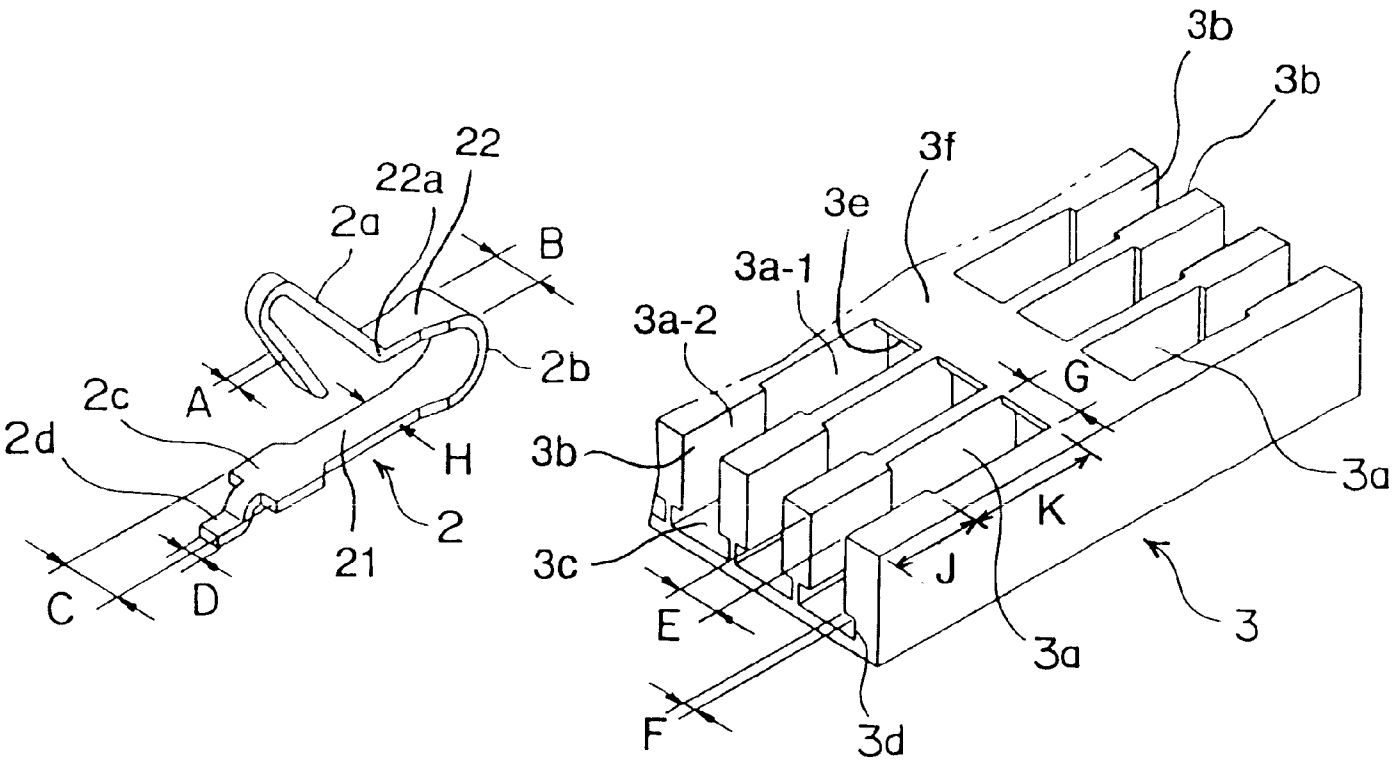
FIG. 6 is a perspective view of a contact and an insulator of the electrical connector according to the embodiment of this invention, before they are assembled together.

As shown in FIG. 6, each of contacts 2 comprise a base portion 21, a contact portion 22 having a U-shaped projection 2*a* slantingly projecting upward at a free end thereof, and a generally U-shaped spring portion 2*b* connecting an end of the base portion 21 and the opposite end of the contact portion 22.

In detail, the contact portion 22 has a shape where it is bent upwardly and slantingly at a bent portion 22*a* to form a slant portion and the slant portion is folded into a U-shape to form the slanting U-shaped projection 2*a*.

The base portion 21 is provided with, as press-fit portions 2*c*, two lateral projections laterally projecting from opposite sides adjacent to the opposite end thereof and a terminal portion 2*d* at the opposite end. The lateral projections or press-fit portions 2*c* are press fit into press-fit grooves 3*d* in the insulator 3. The terminal portion 2*d* is soldered to a circuit pattern on a printed circuit board (11 in FIG. 9A).

Referring to FIGS. 7A–7D in addition, the insulator 3 is provided with a plurality of contact accommodating grooves 3*a* which are disposed symmetrically at both sides of a central partitioning wall 3*e* and extend in parallel with each other at each of the sides. The partitioning wall 3*e* has a top end with a small flanges 3*g* slightly protruding in the opposite directions to the adjacent contact accommodating grooves 3*a*. Thus, the top end of the partitioning wall 3*e* has a relatively large flat surface 3*f* extending over the flange 3*g*. Each of the contact accommodating grooves 3*a* is for accommodating each of the contacts 2 and is defined by a bottom wall 3*c* and opposite side walls so that it is open upward and has an open end opposite to the partitioning wall 3*e*. A pair of projections 3*b* are formed on the opposite side walls at portions adjacent to the open end with small gaps 3*d* being left between the bottom wall 3*c* and lower surface of the projections 3*b*. Therefore, the contact accommodating groove 3*a* has a relatively large width section 3*a*-1 adjacent to the partitioning wall 3*e* and a relatively small width section 3*a*-2 adjacent to the open end. The small gaps 3*d* are for receiving the press-fit portions 2*c* of the contact 2 and will therefore be referred to as press-fit grooves, hereinafter.

The size relations on several portions of both the contact 2 and the insulator 3 are as follows. Assuming that the width of the contact portion 22 is A, the maximum width of the spring portion 2*b* is B, the maximum width of the press-fit portion 2*c* is C, the width of the terminal portion 2*d* is D, the width of the small width section 3*a*-2 is E, the depth of the press-fit groove 3*d* is F, the width of the large width section 3*a*-1 is G, and the width of the base portion 21 of the contact 2 is H, those width sizes have the following relations: A<B, A<C, B<C, B>E, B<G, C>D, E<C, C>E+2F, E<G and H<E. Further, a length of I of the base portion 21 of the contact 2 from the spring portion 2*b* to the lateral projections 2*c* (see FIG. 7A) is larger than a length J of the small width section 3*a*-2 of the contact accommodating groove, that is I>J. A length K of the large width section 3*a*-1 of the contact accommodating groove 3*a* is determined so that the spring portion 2*b* and at least one part of the base portion 21 of the contact 2 can be accommodated therein.

In another embodiment, B can be made equal to or larger than C. Moreover, C can be made equal to or smaller than E+2F.

Figure 7A:
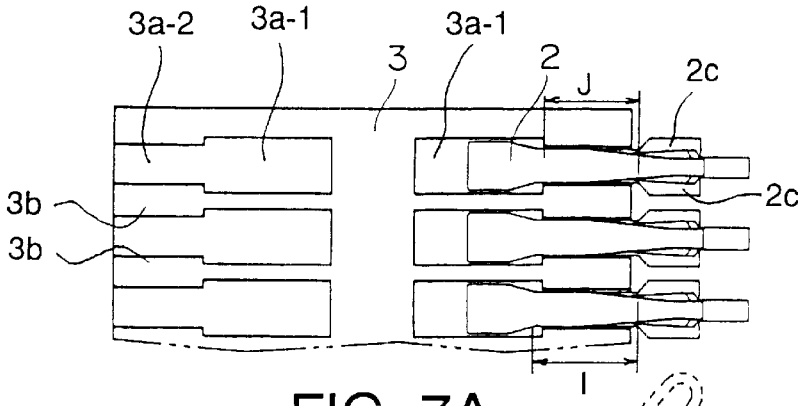
FIG. 7A is a plan view of a first step of the assembling process of the electrical connector according to the embodiment of this invention.
Figure 7B:
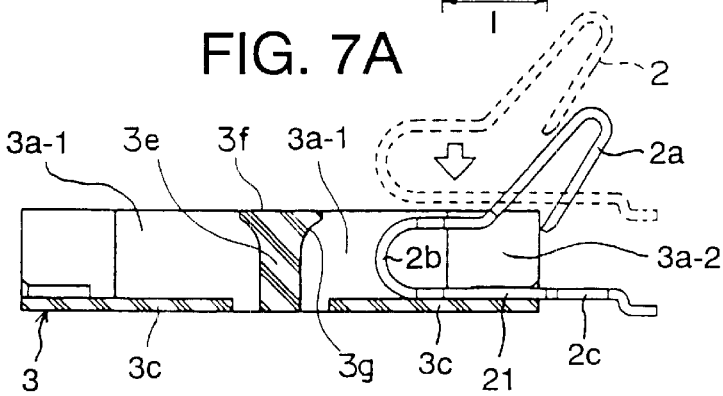
FIG. 7B is a sectional view of the first step the assembling process of the electrical connector according to the embodiment of this invention.
Figure 7C:
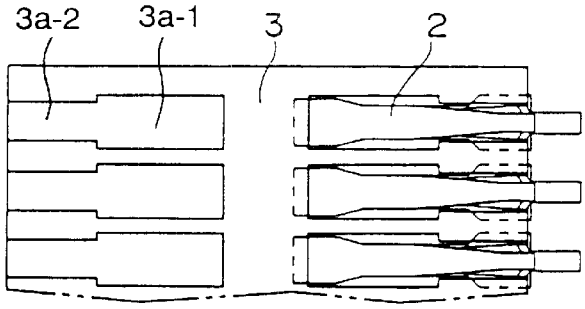
FIG. 7C is a plan view of a second step of the assembling process of the electrical connector according to the embodiment of this invention.
Figure 7D:
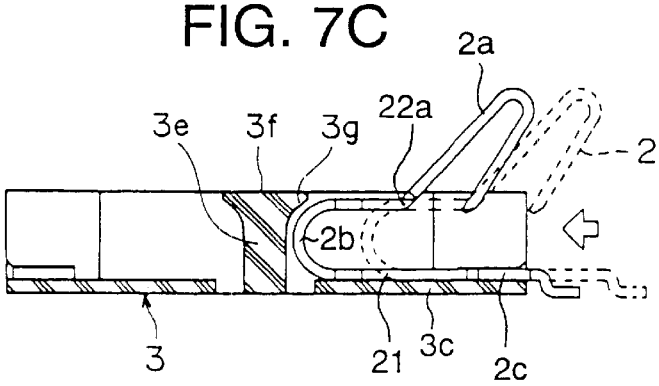
FIG. 7D is a sectional view of the second steep of the assembling process of the electrical connector according to the embodiment of this invention.
Figure 8A:
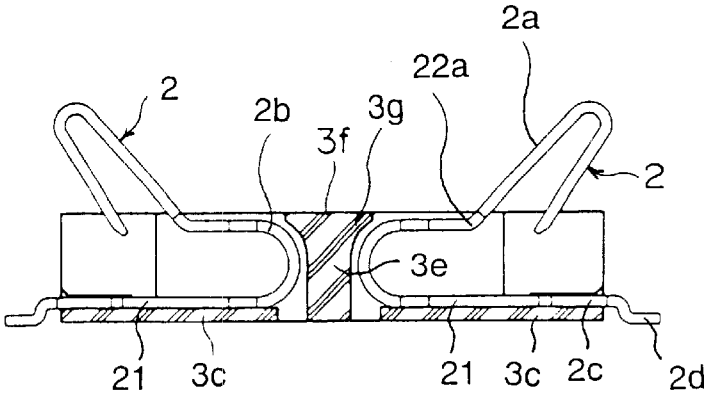
FIG. 8A is a sectional view of the electrical connector according to the embodiment of this invention.

Referring to FIGS. 7A–7D, the description will be made as to the assembling of contact 2 into the insulator 3. At first, the contact 2 is positioned above the contact accommodating groove 3*a* at a state shown by a broken line in FIG. 7B so that a part of the base portion 21 of the contact 2 between the spring portion 2*b* and the lateral projections 2*c* is in registry with the small width section 3*a*-2 of the contact accommodating groove 3*a* while the U-shape spring portion 2*b* is in registry with the large width section 3*a*-1 of the contact accommodating groove 3*a*, as shown in FIGS. 7A and 7B. Then, the contact 2 can be inserted into the contact accommodating groove 3*a* by moving the contact 2 downward, that is, in a direction shown by a blank arrow direction to a position shown by a solid line as shown in FIG. 7B. Then, the base portion 21 is in contact with the base wall 3*c* of the contact accommodating groove 3*a*. Next, the contact 2 is pushed into the contact accommodating groove 3*a* along the bottom wall 3*c* until the spring portion 2*b* is brought into contact with the partitioning wall 3*e*. That is, in FIG. 7D, the contact 2 positioning at a state shown by a broken line is moved to a position shown by a solid line toward a blank arrow direction. At that time, the lateral projections 2*c* is press fit in the press-fit grooves 3*d*, respectively. Thus, the contact 2 is completely assembled in the insulator 3 as shown in FIG. 7C. FIG. 8A shows a state two rows of contacts 2 are completely assembled in the contact accommodating grooves at opposite sides of the partitioning wall 3*e*. The spring portion 2*b* of the contact 2 is positioned just under the flange portion 3*g*. The U-shaped projection 2*a* of the contact portion 22 extends slanting upward.

The connector assembled can be surface-mounted on a printed circuit board (11, in FIGS. 9A and 9B) by the use of vacuum chucking device where a chucking nozzle is brought into contact with the top portion 3*f* of the insulator 3 shown in FIG. 8A and is chucked.

Figure 8B:
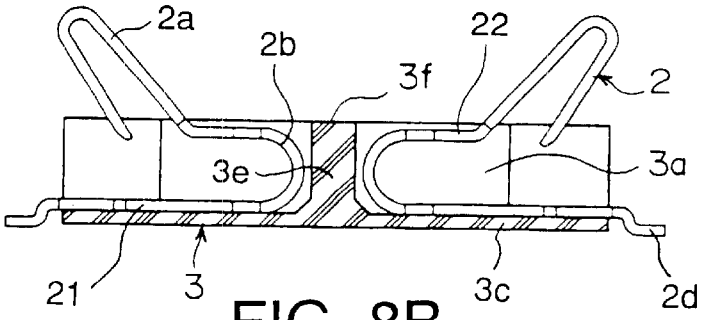
FIG. 8B is a sectional view of another electrical connector according to another embodiment of this invention.

Another connector shown in FIG. 8B is different from that of the embodiment of this invention shown in FIG. 8A. That is, the flanges 3*g* in FIG. 8A are omitted, if the top surface 3*f* of the partitioning wall 3*e* without the flanges 3*g* is insured large sufficient to receive the chucking nozzle.

Figure 9A:
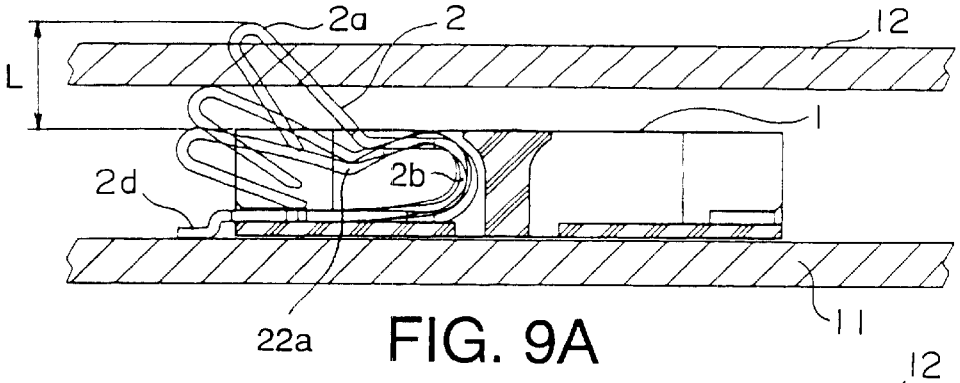
FIG. 9A is a sectional view of the electrical connector according to the embodiment of this invention for describing a process connecting two printed circuit boards to each other with a single contact deforming elastically.
Figure 9B:
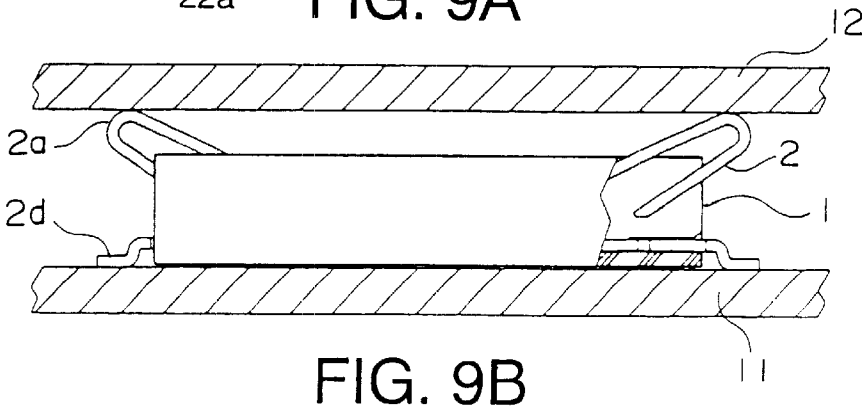
FIG. 9B is a partially sectioned side view of the electrical connector having two rows of contacts shown therein in a state on the way of the connecting process shown in FIG. 9A.

Referring to FIGS. 9A and 9B, in the state where the connector is mounted on the first printed circuit board 11, terminal portions 2*d* are electrically and mechanically connected to circuit patterns (not shown) on the first printed circuit board 11. A second printed circuit board 12 to be connected to the first printed circuit board 11 is disposed so that circuit patterns (not shown) of the second printed circuit board 12 are brought into contact with the U-shaped portions 2*a* of the contacts 2. Next, the second printed circuit board 12 is pushed down toward the first printed circuit board 11. Thereupon, each of the contacts 2 elastically deforms so that the top end of the U-shaped portion 2*a* of the contact portion 22 is brought into press-contact with the circuit pattern of the second printed circuit board. FIG. 9A shows the different three shapes of the contact portion 22. The first one is a first shape thereof without deformation. The second one is a shape on a way of the deformation of the contact portion 22 where spring portion 2*b* is slightly increased in its curvature and the bent portion 22*a* is slightly open. Thus, the U-shaped projection 2*a* is reduced in its slant angle. The third one is a final shape in a state where the second printed circuit 12 is pushed onto the upper surface of the connector, or onto the top surface 3*f* of the partitioning wall 3*e*. The spring portion 2*b* has a further increased curvature and the bent portion 22*a* is further open. Therefore, the U-shaped portion 2*a* has a further reduced slant angle. As a result, the end of the U-shaped projection 2*a* is in contact with the second printed circuit 12 with a relatively large contact pressure which is generated by restoring forces at the bent portion 22*a* and the spring portion 2*b* deformed. Therefore, the circuit pattern of the second printed circuit board 12 can reliably be connected with the circuit pattern of the first printed circuit board 11 by way of the contact 2.

Further, the contact portion 22 is neither displaced below the base portion 21 and the spring portion 2*b* is therefore, nor excessively deformed. Further, the spring portion 2*b* can be formed with an increased width equal to the interval between the press-fit portions 2*c*. Therefore, there is not such a problem that the spring portion 2*b* is plastically deformed.

Moreover, since the base portion 21 is not necessary to have an accommodating hole which permits the contact portion 22 to displace below the base portion 21, the contact can be formed with a reduced width. Therefore, the connector can be formed with a further compact size.

The embodiments have been described in connection with two printed circuit boards 11 and 12, the connector according to this invention can be used for connecting other electronic devices with each other. For example, a LCD panel is used in place of the printed circuit board 12. A flexible printed circuit is also used in place of printed circuit board 11.

What is claimed is:

1. An electrical connector having at least one contact (2) held in at least one contact accommodating groove (3*a*) formed in an insulator (3), said contact accommodating groove (3*a*) being defined by a bottom wall (3*c*) and an open top, opposite sidewalls, an end wall (3*e*) closing one end of said groove, an opposite end of said groove being open, said contact (2) comprising a base portion (21) press-fitted in the contact accommodating groove (3*a*), a contact portion (22) projecting upwardly (2*a*) from the contact accommodating groove (3*a*), and a U-shape spring portion (2*b*) connecting the base portion (21) and the contact portion (22), wherein:

said contact accommodating groove (3*a*) comprises a relatively large width section (3*a*-1) adjacent to the end wall (3*e*) and a relatively small width section (3*a*-2) adjacent to the open end;

said opposite sidewalls at the relatively small width section (3*a*-2) being formed with press-fit grooves (3*d*) adjacent to the bottom wall (3*c*);

said base portion (21) of the contact (2) being formed with lateral projections (2*c*) laterally projecting from the opposite sides of the base portion (21), said lateral projections (2*c*) being press-fit in said press-fit grooves (3*d*) respectively; and said base portion (21) of the contact (2) has a slender part which extends between said U-shape spring portion (2*b*) and said lateral projections (2*c*) and have a width which is smaller than the width of the relatively small width section (3*a*-2) of the contact accommodating groove (3*a*).

2. An electrical connector as claimed in claim 1, wherein said U-shape spring portion (2*b*) of said contact (2) has a first width dimensioned to fit into and be secured within said relatively large width section (3*a*-1) of the contact accommodating groove (3*a*), wherein said first and large widths are approximately but equal.

3. An electrical connector as claimed in claim 2, wherein a width of said contact portion (22) of said contact (2) is smaller than a width of said U-shape spring portion (2*b*), and said contact portion (22) is slantingly and upwardly bent at a bent portion apart from said U-shape spring portion and is folded to form a U-shaped folded portion (2*a*) projecting slantingly and upwardly.

4. An electrical connector as claimed in claim 3, wherein a plurality of said contacts (2) are accommodated in a plurality of contact accommodating grooves (3*a*), respectively.

5. An electrical connector as claimed in claim 4, wherein said plurality of contact accommodating grooves (3*a*) are arranged at opposite sides of a central partitioning wall (3*e*) and in parallel with each other at each of the opposite sides of said partition wall.

6. An electrical connector as claimed in claim 5, wherein said end wall of each of said plurality of contact accommodating grooves (3*a*) is defined by said partitioning wall (3*e*).

7. An electrical connector as claimed in claim 6, wherein said partitioning wall has top edges with small flange portions (3*g*) oppositely disposed therefrom and extending into said contact accommodating grooves (3*a*) at both sides of said partitioning wall (3*e*), said top edges and said flange portions forming a flat upper surface (3*f*).

8. An electrical connector having a plurality of contacts (2) held in a plurality of open top contact accommodating grooves (3*a*) formed in an insulator (3), respectively, each of said contact accommodating grooves (3*a*) being defined by a bottom wall (3*c*), opposite sidewalls, closed on one end by an end wall (3*e*) and said groove being open at an opposite end of said groove, each of said contacts (2) comprising a base portion (21) press-fitted in a corresponding one of the contact accommodating grooves (3*a*), a contact portion (22) projecting upwardly (2*a*) from the corresponding contact accommodating groove (3*a*) and a U-shape spring portion (2*b*) connecting the base portion (21) and the contact portion (22), wherein:

each of said contact accommodating grooves (3*a*) comprises a relatively large width section (3*a*-1) adjacent to the end wall (3*e*) and a relatively small width section (3*a*-2) adjacent to the open end;

said opposite side walls at the relatively small width section (3*a*-2) are formed with press-fit grooves (3*d*) adjacent to the bottom wall (3*c*);

said base portion (21) of the contact (2) is formed with lateral projections (2*c*) laterally projecting from the opposite sides of the base portion (21), said lateral projections (2*c*) being press-fit in said press-fit grooves (3*d*) respectively; and said base portion (21) of the contact (2) has a slender part which extends between said U-shape spring portion (2*b*) and said lateral projections (2*c*) having a width smaller than the width of the relatively small width section (3*a*-2) of the contact accommodating groove (3*a*).

9. An electrical connector as claimed in claim 8, wherein said U-shape spring portion (2*b*) of said contact (2) has a first width dimensioned to fit into and be secured within said relatively large width section (3*a*-1) of the contact accommodating groove (3*a*), whereby said first and large widths are approximately but not quite equal.

10. An electrical connector as claimed in claim 9, wherein a width of said contact portion (22) of said contact (2) is smaller than a width of said U-shape spring portion (2*b*), and said contact portion (22) is slantingly and upwardly bent at a bent portion apart from said U-shape spring portion and is folded to form a U-shaped folded portion (2*a*) projecting slantingly and upwardly.

11. An electrical connector as claimed in claim 8, wherein said plurality of contact accommodating grooves (3*a*) are arranged at opposite sides of a central partitioning wall (3*e*) and in parallel with each other at each of the opposite sides of said partition wall.

12. An electrical connector as claimed in claim 11, wherein said end wall of each of said plurality of contact accommodating grooves (3*a*) is defined by said partitioning wall (3*e*).

13. An electrical connector as claimed in claim 12, wherein said partitioning wall has a top edge with small flange portions (3*g*) oppositely disposed therefrom and extending into said contact accommodating grooves (3*a*) at both sides of said partitioning wall (3*e*), said top edge and said flange portion forming a flat upper surface (3*f*).

14. An electrical connector having a plurality of contacts (2) for use in making an electrical connection with a first connection object (11) and with a second connection object (12) said first electrical connection object being electrically and mechanically mounted while said second connection object being brought into contact with said contacts (2), said electrical connector comprising:

an insulator (3) having a plurality of open topped contact accommodating grooves (3*a*) formed in said insulator (3) for accommodating said contacts, respectively;

each of said contact accommodating grooves (3*a*) being defined by a bottom wall (3*c*), opposite sidewalls, an end wall (3*e*) on an end of said groove, the opposite end of said groove being open;

each of said contact accommodating grooves (3*a*) comprising a relatively large width section (3*a*-1) adjacent to the end wall (3*e*) and a relatively small width section (3*a*-2) adjacent to the open end; and said opposite side walls at the relatively small width section (3*a*-2) being formed with press-fit grooves (3*d*) adjacent to the bottom wall (3*c*);

each of said contacts (2) comprising a base portion (21) supported on said base wall (3*c*) and captured in the corresponding one of said contact accommodating grooves (3*a*), a contact portion (22) projecting (2*a*) from the contact accommodating groove (3*a*) upwardly, and a U-shape spring portion (2*b*) connecting the base portion (21) and the contact portion (22);

said base portion (21) of the contact (2) being formed with lateral projections (2*c*) laterally projecting from the opposite sides of the base portion (21), said lateral projections (2*c*) being press-fit in said press-fit grooves (3*d*) respectively; and said base portion (21) of the contact (2) having a slender part which extends between said U-shape spring portion (2*b*) and said lateral projections (2*c*) having a width which is smaller than the width of the relatively small width section (3*a*-2) of the contact accommodating groove (3*a*);

said U-shape spring portion (2*b*) of said contact (2) having a width that fits into and is captured within the width of said relatively large width section (3*a*-1) of the contact accommodating groove (3*a*); and said contact portion (22) of said contact (2) having a width smaller than said U-shape spring portion (2*b*), and said contact portion (22) being slantingly and upwardly bent at a bent portion apart from said U-shape spring portion and is folded to form a U-shaped folded portion (2*a*) projecting slantingly and upwardly.

15. An electrical connector as claimed in claim 14, wherein said plurality of contact accommodating grooves (3*a*) are arranged at opposite sides of a central partitioning wall (3*e*) and in parallel with each other on each of the sides of said central partitioning wall.

16. An electrical connector as claimed in claim 15, wherein said end wall of each of said plurality of contact accommodating grooves (3*a*) is defined by said partitioning wall (3*e*).

17. An electrical connector as claimed in claim 16, wherein said partitioning wall has a top edge with small flange portions (3*g*) extending oppositely therefrom and into said contact accommodating grooves (3*a*) at opposite sides of said partitioning wall (3*e*), said top edge and said flange portions forming a flat upper surface (3*f*).

* * * * *